US010239276B2

(12) United States Patent
Carlson et al.

(10) Patent No.: US 10,239,276 B2
(45) Date of Patent: Mar. 26, 2019

(54) COMPACT DUNNAGE CONVERTER

(71) Applicant: Ranpak Corp., Concord Township, OH (US)

(72) Inventors: Daniel L. Carlson, Ravenna, OH (US); Donald A. Gorg, Florence, SC (US); Thomas A. Bilkie, Medina, OH (US)

(73) Assignee: RANPAK CORP., Concord Township, OH (US)

( * ) Notice: Subject to any disclaimer, the term of this patent is extended or adjusted under 35 U.S.C. 154(b) by 1615 days.

(21) Appl. No.: 13/832,044

(22) Filed: Mar. 15, 2013

(65) Prior Publication Data

US 2013/0196839 A1 Aug. 1, 2013

Related U.S. Application Data

(62) Division of application No. 12/796,112, filed on Jun. 8, 2010, now Pat. No. 8,419,606, which is a division (Continued)

(51) Int. Cl.
*B31D 5/00* (2017.01)

(52) U.S. Cl.
CPC ..... *B31D 5/0043* (2013.01); *B31D 5/0047* (2013.01); *B31D 2205/0035* (2013.01);

(Continued)

(58) Field of Classification Search
CPC ..... B31D 5/0043; B31D 5/0047; B31D 2205/0035; B31D 2205/0082; B31D 2205/0088

(Continued)

(56) References Cited

U.S. PATENT DOCUMENTS 3,646,423 A 2/1972 Tatematsu et al.
3,654,539 A 4/1972 Schnur et al.

(Continued)

FOREIGN PATENT DOCUMENTS

WO 2000/26015 A1 5/2000
WO 01/094107 12/2001

(Continued)

OTHER PUBLICATIONS

European Search Report dated May 3, 2016, for corresponding EP Application No. 15179755.2.

*Primary Examiner* — Sameh Tawfik
(74) *Attorney, Agent, or Firm* — Renner, Otto, Boisselle & Sklar, LLP

(57) ABSTRACT

A compact dunnage conversion machine includes a converging chute with a restricted inlet, a powered feed assembly with a sealed gearbox, a plurality of interchangeable power supplies, and a restricted outlet chute. The converter can convert a sheet stock material into dunnage for use in packaging one or more objects in a container. The restricted inlet and outlet make it more difficult for foreign objects to enter the converter and disrupt the conversion process. The sealed gearbox interposed between the driving elements of the feed assembly and an electric motor facilitates maintenance and repair of the feed assembly, while also protecting the gears therein. Finally, the power supplies provide electrical power to the motor and can include an electrical storage device, such as a battery, or an alternating-current-to-direct-current converter which is connectable to a source of electricity for supplying that electricity to the motor in an acceptable form.

5 Claims, 10 Drawing Sheets

Related U.S. Application Data of application No. 11/761,099, filed on Jun. 11, 2007, now abandoned.

(60) Provisional application No. 60/804,431, filed on Jun. 10, 2006.

(52) U.S. Cl.
CPC ..... *B31D 2205/0047* (2013.01); *B31D 2205/0082* (2013.01)

(58) Field of Classification Search
USPC ..... 493/464
See application file for complete search history.

(56) References Cited

U.S. PATENT DOCUMENTS

| | | | | |
|---|---|---|---|---|
| 3,655,500 | A | 4/1972 | Johnson | |
| 3,799,039 | A | 3/1974 | Johnson | |
| 5,131,903 | A | 7/1992 | Levine et al. | |
| 5,674,172 | A | 10/1997 | Armington et al. | |
| 5,715,156 | A | 2/1998 | Yilmaz et al. | |
| 5,791,522 | A * | 8/1998 | Lee | B05B 7/0408 222/145.5 |
| 5,873,809 | A | 2/1999 | Kempster et al. | |
| 5,938,580 | A | 8/1999 | Siekmann | |
| 6,016,047 | A | 1/2000 | Notten et al. | |
| 6,018,293 | A | 1/2000 | Smith | |
| 6,021,499 | A | 2/2000 | Aleshi | |
| 6,179,765 | B1 * | 1/2001 | Toth | B26D 7/24 493/360 |
| 6,296,065 | B1 | 10/2001 | Carrier | |
| 6,529,389 | B2 | 4/2003 | Perlick et al. | |
| 6,918,489 | B2 | 7/2005 | Harding et al. | |
| 7,186,208 | B2 | 3/2007 | Demers et al. | |
| 7,596,002 | B2 | 9/2009 | Teichmann | |
| 7,651,455 | B2 * | 1/2010 | Yampolsky | B26F 1/22 493/407 |
| 7,788,884 | B2 | 9/2010 | Cheich et al. | |
| 8,550,971 | B2 * | 10/2013 | Chan | B31D 5/0047 493/350 |
| 2003/0127932 | A1 | 7/2003 | Ishida et al. | |
| 2004/0051388 | A1 | 3/2004 | Lin | |
| 2004/0266598 | A1 | 12/2004 | Toth | |
| 2005/0181924 | A1 * | 8/2005 | Demers | B26F 3/02 493/350 |

FOREIGN PATENT DOCUMENTS

| | | |
|---|---|---|
| WO | 03/089163 | 10/2003 |
| WO | 2005/007394 A2 | 1/2005 |

* cited by examiner

COMPACT DUNNAGE CONVERTER

FIELD OF THE INVENTION

The present invention relates generally to a dunnage converter for converting a sheet stock material into a dunnage product, and various improvements thereof.

BACKGROUND

Dunnage conversion machines, also referred to as converters, generally convert a sheet stock material into a strip of dunnage. The dunnage is then placed in a container with one or more objects for shipment.

Some converters produce a dunnage product primarily to provide cushioning in a packaging container to prevent or minimize damage to the contents during shipment. U.S. Pat. No. 5,674,172, for example, which is hereby incorporated herein by reference, discloses a cushioning conversion machine for converting a sheet stock material into a cushioning dunnage product. The cushioning conversion machine includes a forming assembly that causes inward rolling of the lateral edges of the sheet stock material to form a strip having a three-dimensional shape with lateral pillow-like portions separated by a thin central band. The forming assembly includes a shaping member over which the sheet stock material is drawn and a converging chute cooperative with the shaping member to roll the edges of the stock material inward to form the lateral pillow-like portions. A feed mechanism downstream of the forming assembly pulls the stock material through the forming assembly. The feed mechanism also connects overlapping layers of stock material along the thin central band. The feed mechanism has a pair of rotating gear-like members that engage and pull the stock material over the shaping member, through the converging chute, and connect, by coining, the overlapping layers in the thin central band to maintain the three-dimensional shape of the strip. The conversion machine further includes a cutting mechanism for cutting the strip into cut sections, or pads, of a desired length for use as a protective cushioning dunnage product.

Other converters produce a dunnage product primarily to fill voids in a packaging container to prevent or minimize shifting of the contents during shipment. These machines typically operate at relatively high speeds. An exemplary dunnage converter is disclosed in International Patent Application No. PCT/US2001/018678, published under Publication No. WO 01/0194107 on Dec. 13, 2001, and International Patent Application No. PCT/US2003/012301, filed on Apr. 22, 2003, and published under Publication No. WO 03/089163 on Oct. 30, 2003, both of which are hereby incorporated herein by reference.

An exemplary machine of this type includes a forming assembly for shaping a sheet stock material into a continuous strip of dunnage and a pulling assembly for advancing the sheet material through the forming assembly. The forming assembly includes a funnel portion, similar to a converging chute, through which the sheet stock material passes for shaping the sheet stock material into the strip of dunnage and directing the formed strip to the pulling assembly. The pulling assembly includes at least two opposed grippers, at least one of which is moveable through a dunnage transfer region in opposition to the other gripper. The grippers are cooperative to define an aperture therebetween and to grip the sheet stock material therein and advance it through the transfer region. The moving gripper includes a plurality of paddles that aid in defining the aperture and in engaging the sheet stock material. The grippers can help to crease the crumpled folds in the strip to help it maintain its shape. Due to the aperture between the grippers, however, the grippers generally cannot coin or stitch together the layers of stock material passing therebetween, in contrast to the gear-like members in the aforementioned cushioning conversion machine.

SUMMARY

A compact dunnage conversion machine includes a converging chute with a restricted inlet, a powered feed assembly with a sealed gearbox, a plurality of interchangeable power supplies, and a restricted outlet chute. The converter can convert a sheet stock material into dunnage for use in packaging one or more objects in a container. The restricted inlet and outlet make it more difficult for foreign objects to enter the converter and disrupt the conversion process. The sealed gearbox interposed between the driving elements of the feed assembly and an electric motor facilitates maintenance and repair of the feed assembly, while also protecting the gears therein. Finally, the power supplies provide electrical power to the motor and can include an electrical storage device, such as a battery, or an alternating-current-to-direct-current converter which is connectable to a source of electricity for supplying that electricity to the motor in an acceptable form.

Accordingly, a dunnage converter for converting a stock material into a relatively less dense dunnage product comprises a powered feed assembly and at least two power supplies. The feed assembly has at least one rotatable member for engaging and feeding stock material, and an electric direct current motor for driving the at least one rotatable member. The power supplies are interchangeably connectable to the motor. A first power supply has a battery, and a second power supply is connectable to a source of alternating current and has an alternating-current-to-direct-current converter for supplying direct current to the motor. In a packaging system, the converter may be mounted on a stand, which also may support a power supply and/or a supply of sheet stock material.

Another dunnage converter for converting a sheet stock material into a relatively less dense dunnage product comprises a powered feed assembly for feeding the stock material that has at least one rotatable member, a motor for driving the at least one rotatable member and a gear box interposed between the at least one rotatable member and the motor for transferring rotational motion from the motor to the at least one rotatable member. The gear box includes a housing that encloses at least one gear, and the housing has a first opening therein for receipt of a shaft of the motor and a second opening for receipt of a shaft for each rotatable member. The motor shaft may pass through one side of the housing and the shaft for the rotatable member may pass through an opposing side of the housing. The motor may be mounted to the gear box housing.

Still another dunnage converter for converting a sheet stock material into a relatively less dense dunnage product, comprises a converging chute having a first pair of opposed side walls that generally converge towards each other in a downstream direction and a second pair of opposed top and bottom walls that interconnect the side walls. The top and bottom walls define a constriction adjacent an upstream end of the chute where the top and bottom walls gradually converge toward each other to define a minimum distance therebetween of no more than about 30 mm.

Another dunnage converter for converting a stock material into a relatively less dense dunnage product comprises a powered feed assembly for feeding a stock material and an output chute downstream of the feed assembly that guides the stock material to an outlet opening thereof that is spaced from the feed assembly. The output chute has a pair of opposed walls that have a minimum distance therebetween of no more than about 32 mm adjacent the outlet opening. The output chute may have a length of about 150 mm to about 200 mm.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

Figure 13:
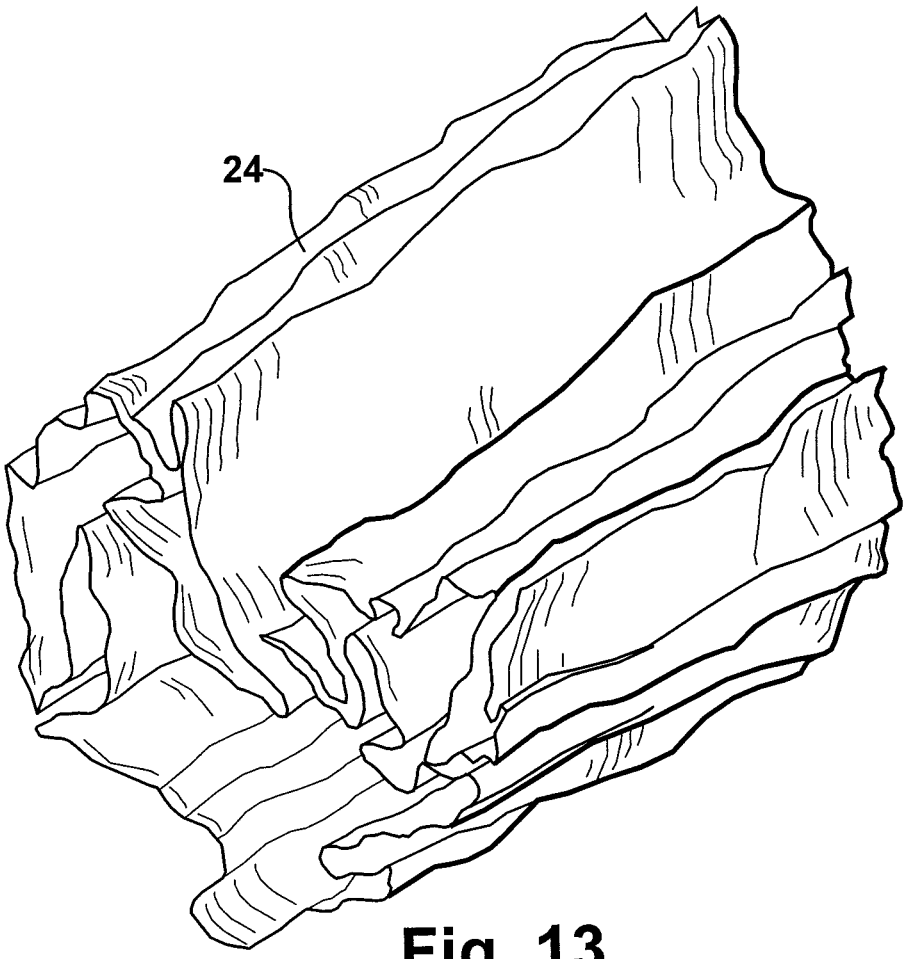
FIG. 13 is a perspective view of an exemplary strip of dunnage.

Referring now in detail to the drawings, and initially FIGS. 1-9, FIG. 1 shows an exemplary compact dunnage conversion machine (i.e., converter) 20 for converting a sheet stock material 22 (FIG. 3) into a strip 24 (FIG. 13) of dunnage. The converter 20 is part of a packaging system 26 that also includes an adjustable stand 40, shown in FIG. 2, on which the converter 20 is mountable at an elevated location.

Figure 2:
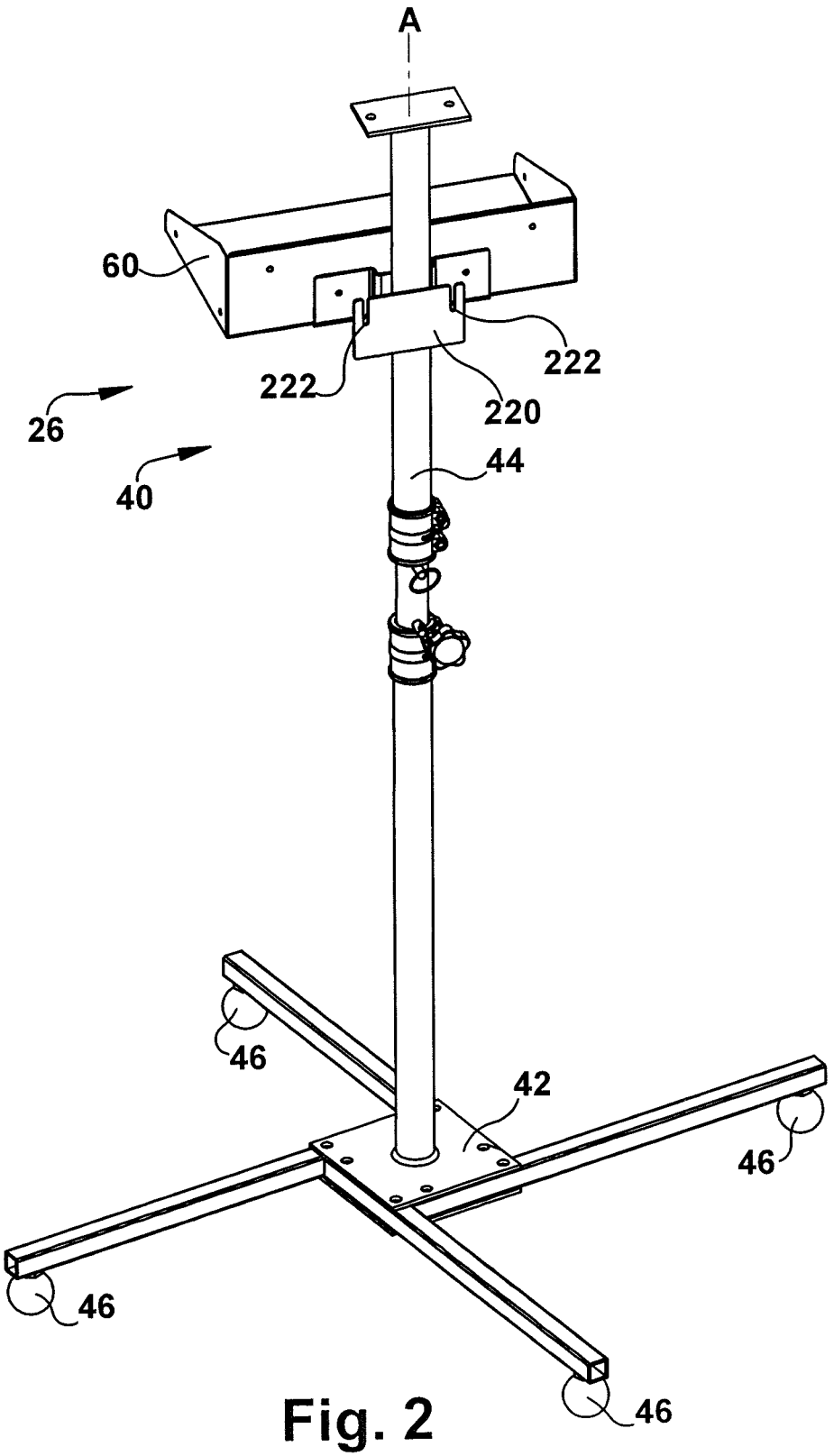
FIG. 2 is a perspective view of a stand for supporting the conversion machine and a supply of sheet stock material at an elevated position.

The stand 40 shown in FIG. 2 includes a base 42 and a telescopically adjustable upright 44 to which the converter 20 can be secured. The base 42 includes wheels 46 so that the stand 40 may be moved easily. The base 42 of the stand 40 can have a different configuration, however, such as a clamp for mounting on a table.

Figure 1:
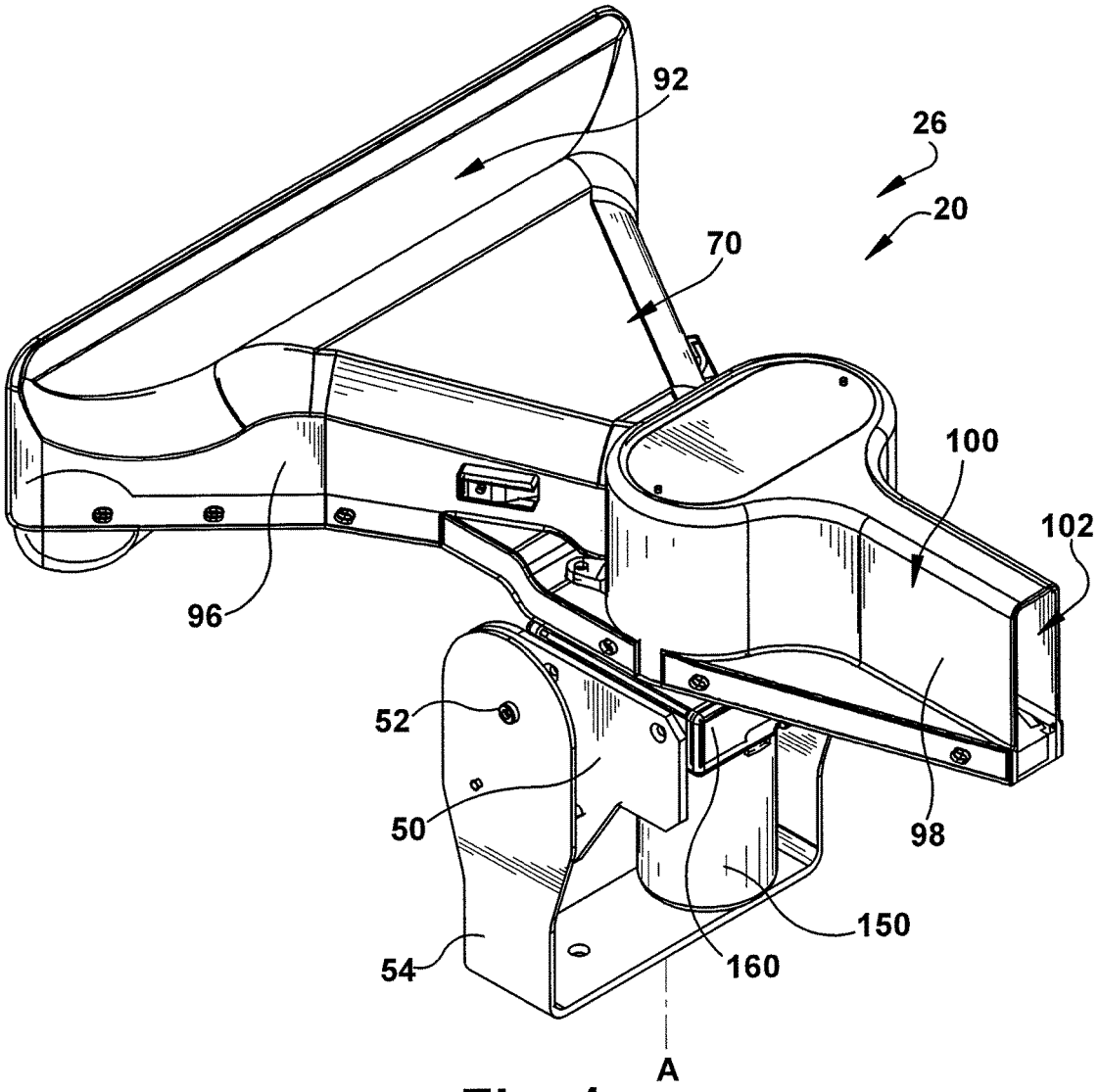
FIG. 1 is a perspective view of an exemplary dunnage conversion machine provided in accordance with the present invention, looking from above and toward an upstream end of the conversion machine.
Figure 9:
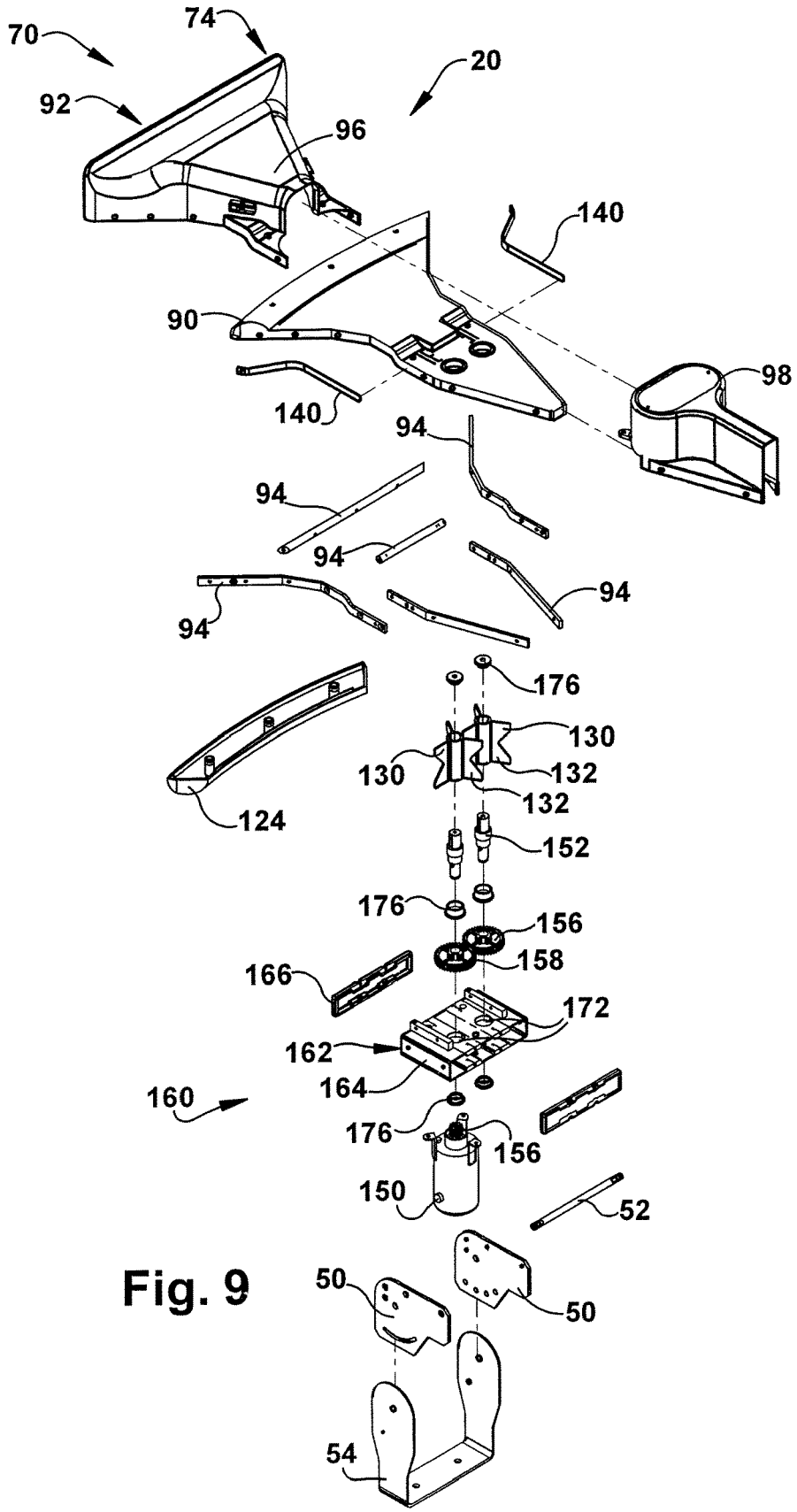
FIG. 9 is an exploded view of the conversion machine shown in FIG. 1.

Referring now to FIG. 9 as well, the converter 20 is mountable to the stand 40 via a pair of rotating guide plates 50 pivotally rotatable through a pivot shaft 52 passing therethrough to the arms of a generally U-shape bracket 54, the base of which can be secured to the stand at "A" in FIGS. 1 and 2. The stand 40 and the converter mounting bracket 54 cooperate to allow a packer to orient the converter 20 so that the converter 20 discharges dunnage products exactly where the packer wants them. Specifically, the stand 40 and the converter mounting bracket 54 operate to allow the packer both to rotate the converter 30 about a substantially vertical axis and to pivot the converter 20 about a substantially horizontal axis. The illustrated stand 40 also allows the packer to raise and lower the height of the converter 20. This adjustability provides several advantages. Rotating the converter 20, for example, allows multiple packers, spaced around the vertical rotation axis of the stand 40 at separate packing stations, to use the same converter 20. That is, the converter 20 can be swung back and forth between the two packing stations as needed. Pivoting the converter 20 about a horizontal axis allows the packer to change the angle at which the dunnage exits the converter 20 relative to the stand 40 or a packing surface (not shown). In addition, adjusting the height of the stand may be desirable to accommodate different ranges of box sizes, or packers of different heights, for example.

Figure 3:
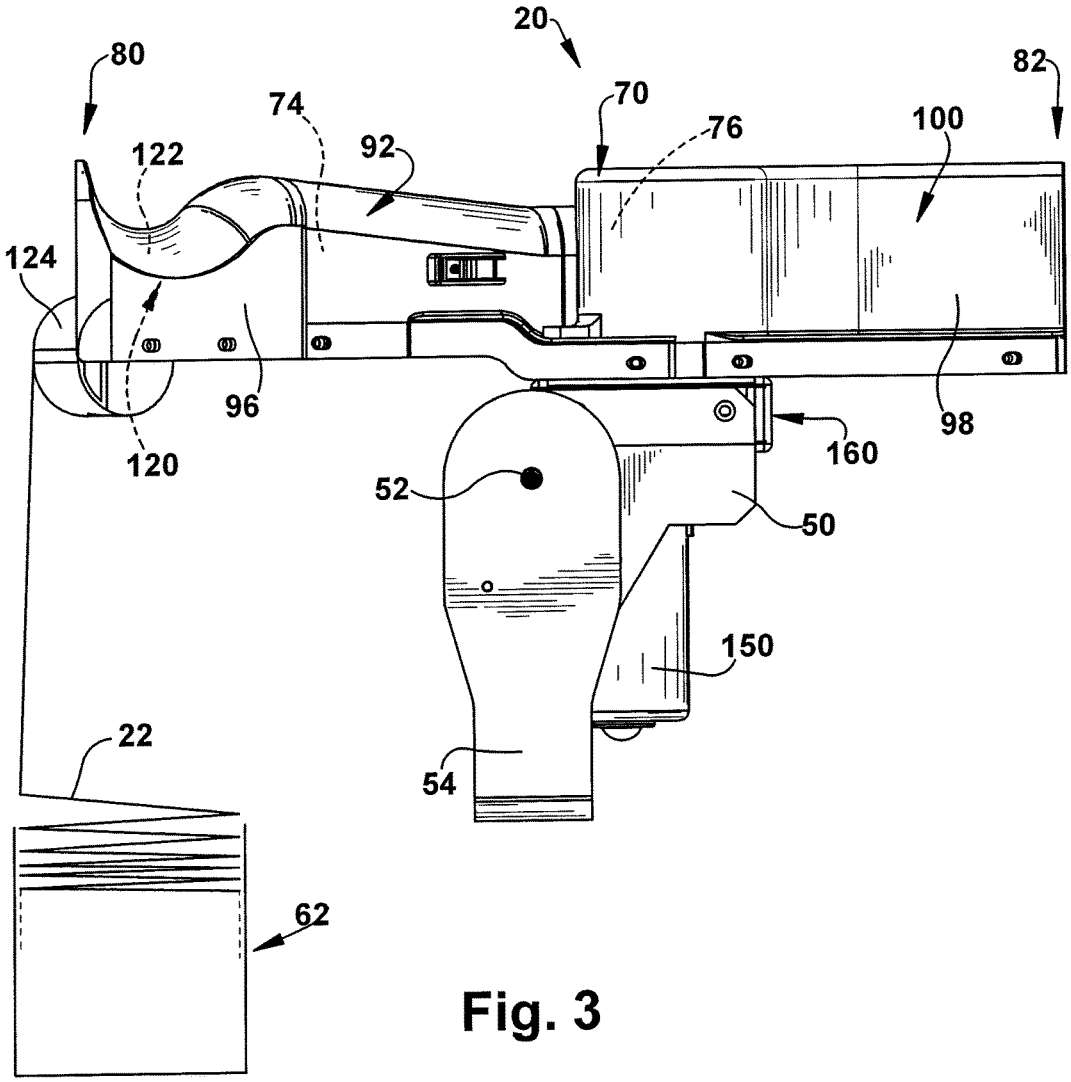
FIG. 3 is a side view of the conversion machine of FIG. 1.

The stand 40 also includes a support, such as the illustrated tray 60 mounted to the upright, for supporting a supply 62 of sheet stock material 22, such as that shown in FIG. 3. The supply 62 supplies the converter 20 with one or more plies of sheet stock material, which typically consists of paper, particularly kraft paper, and typically about fifteen inch (about thirty-eight centimeters) wide to about thirty inch (about seventy-six centimeters) wide kraft paper. A common width in twenty-two and a half inches (about fifty-seven centimeters). A paper dunnage product is an environmentally responsible protective packaging material; paper is recyclable, reusable and composed of a renewable resource. Other sheet materials may be suitable alternatives to paper, however.

The stock material preferably is perforated or otherwise weakened in regions that extend across its width and are spaced apart along the length of the stock material. The stock material typically is supplied as a continuous fan-folded stack that is perforated at the folds. These weakened regions make it easier to separate dunnage products from the strip of dunnage, for example by tearing, so that a desired length of dunnage can be torn from the strip as it emerges from the converter.

The converter 20 includes a housing 70 that encloses a conversion assembly 72 for converting the stock material into a dunnage product. The conversion assembly 72 includes a converging chute 74 and a powered feed assembly 76 downstream of the converging chute 74. The sheet stock material 22 is fed into an upstream end 80 of the converter housing 70 and the feed assembly 76 pulls the stock material from the supply (not shown) and through the converging chute 74. The converging chute 74 inwardly gathers and crumples the stock material into the shape of a crumpled strip or rope 24 (FIG. 13) having a generally round cross-sectional shape, typically with one or more longitudinallyextending crumpled lobes. The converted stock material exits the housing 70 at a downstream end 82 of the converter 20 as the completed dunnage strip. The terms "upstream" and "downstream" are used herein to refer to the flow of the stock material through the converter 20, from the upstream end 80 of the converter to the downstream end 82.

In the illustrated embodiment, the housing 70 has a relatively planar bottom portion 90 that forms the bottom wall and a top portion 92 having a generally U-shape cross-section that forms the side and top walls. The bottom portion 90 in the illustrated embodiment has a hollow shape that is about seventeen millimeters thick with one or more stiffening brackets 94 mounted thereto to provide additional support and to increase the rigidity of the converter housing 70. The top portion 92 of the converter housing 70 includes an upstream section 96 that provides the top of the converging chute 74, and a downstream section 98 that covers the feed assembly 76. The downstream section 98 also helps to form an outlet chute 100 downstream of the feed assembly 76 that terminates at an outlet opening 102. The illustrated housing 70, with its two readily removable upper sections 96 and 98, simplifies maintenance and operation of the converter 20. The housing 70 and components of the conversion assembly 72 therein generally define the path of the stock material through the converter 20 in a substantially upstream to downstream direction.

Figure 4:
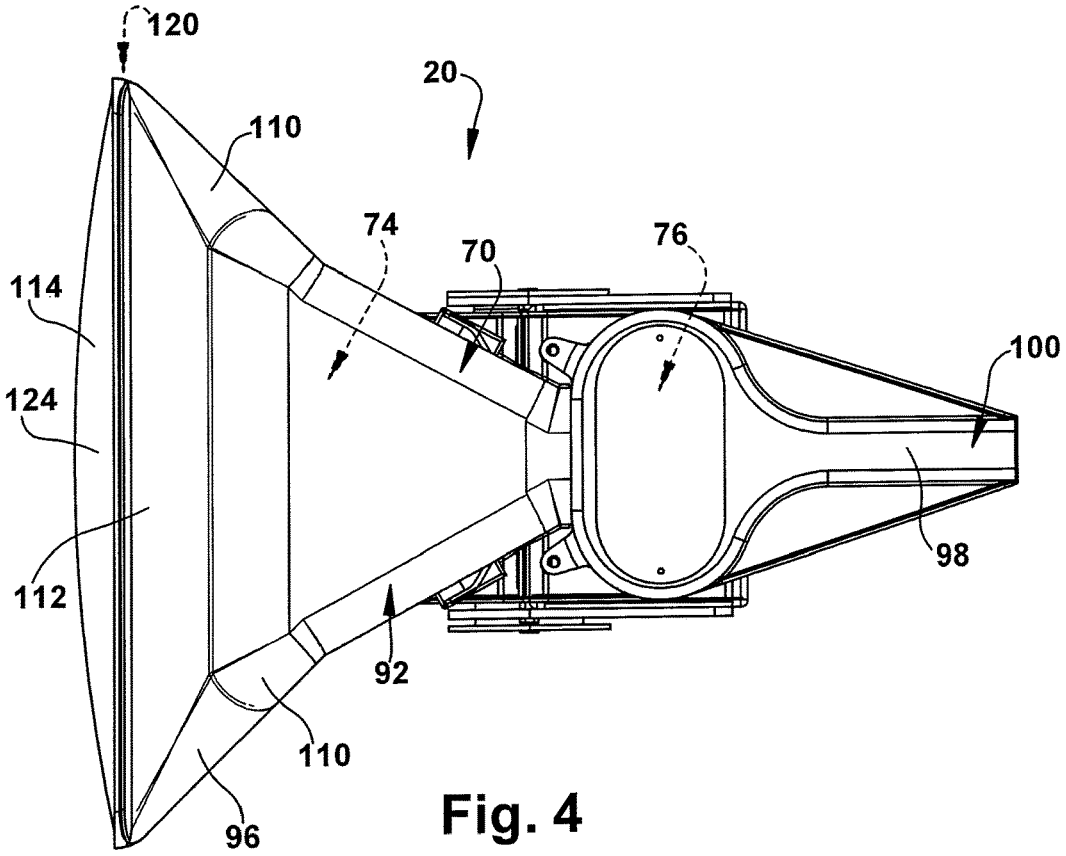
FIG. 4 is a top view of the conversion machine of FIG. 1.
Figure 5:
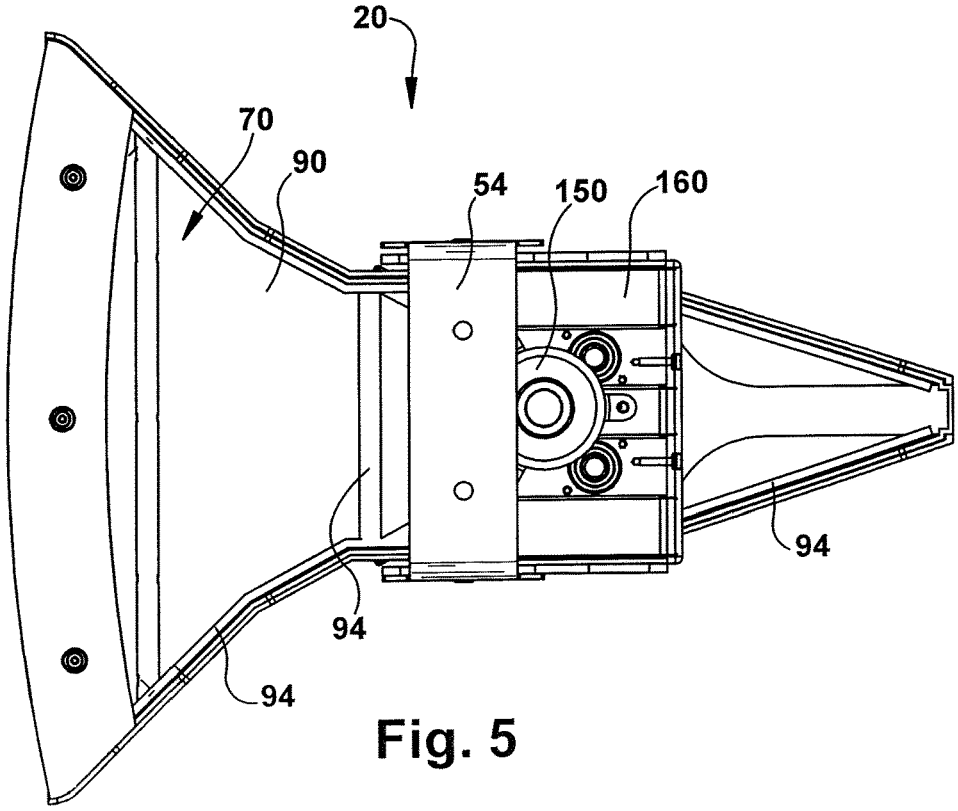
FIG. 5 is a bottom view of the conversion machine of FIG. 1.
Figure 6:
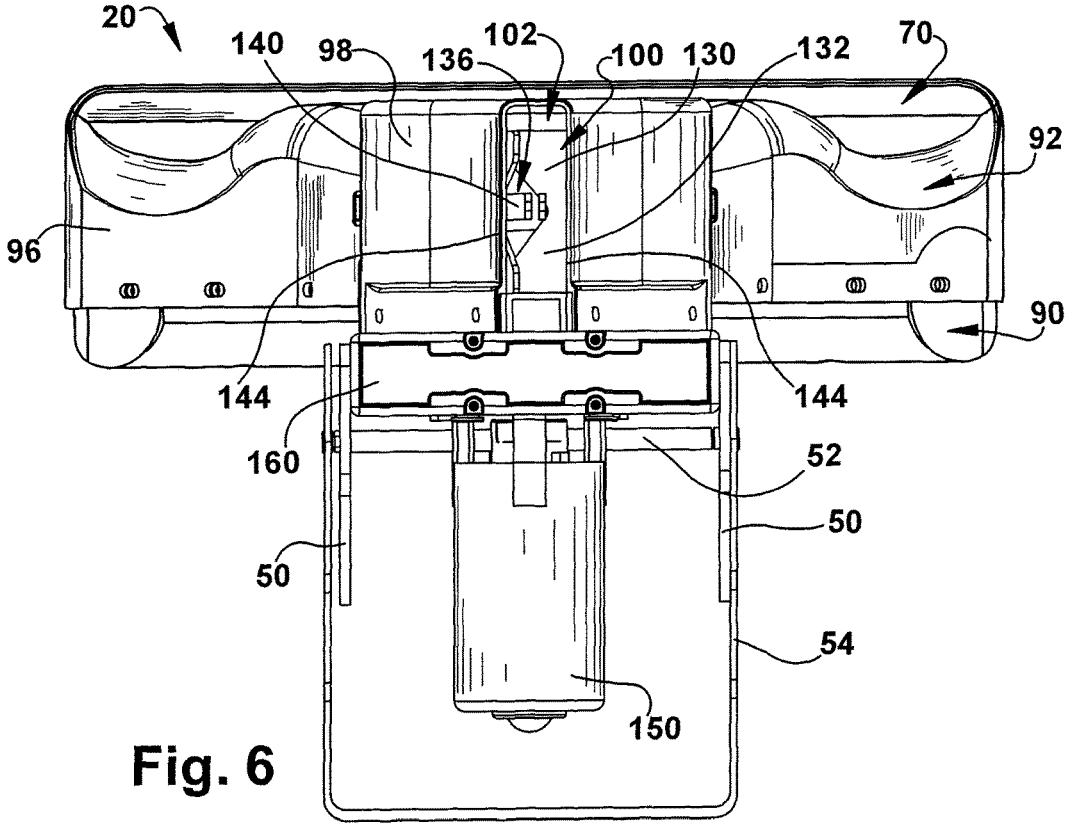
FIG. 6 is a front view of the conversion machine of FIG. 1, looking from the downstream end toward the upstream end of the conversion machine.
Figure 7:
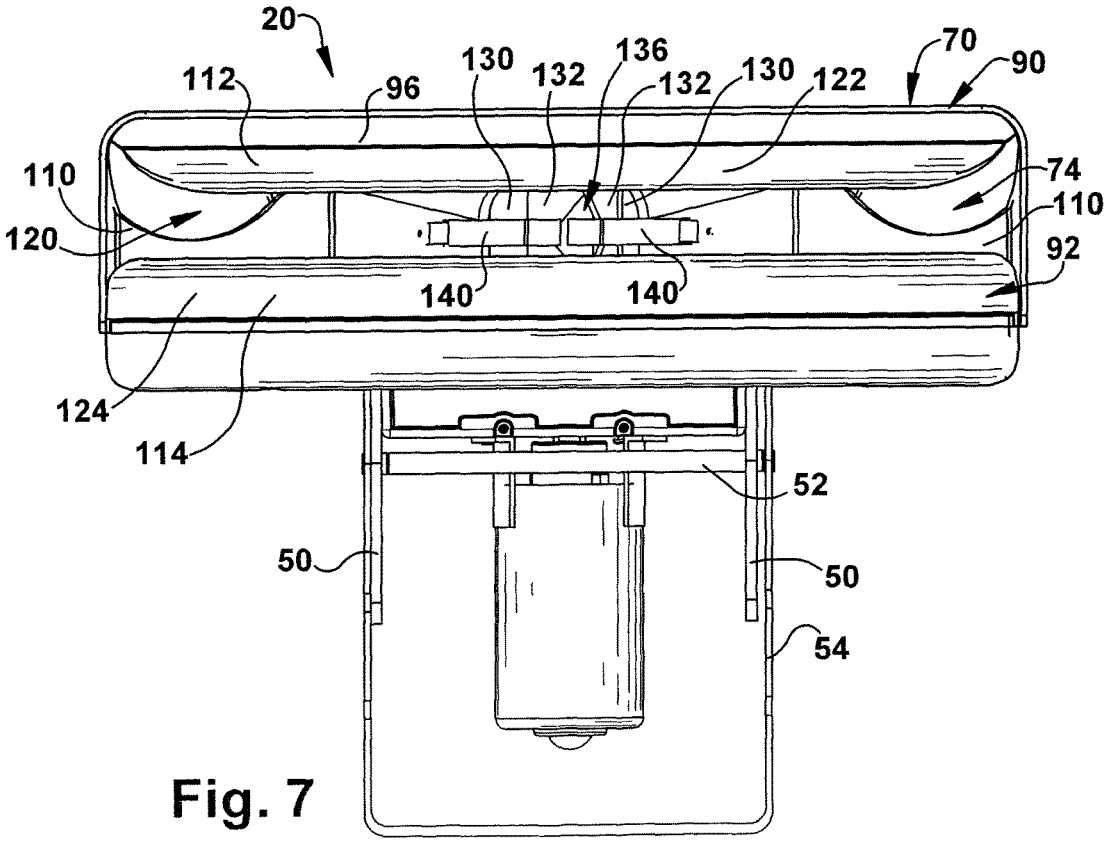
FIG. 7 is a rear view of the conversion machine of FIG. 1, looking from the upstream end toward the downstream end of the conversion machine.
Figure 8:
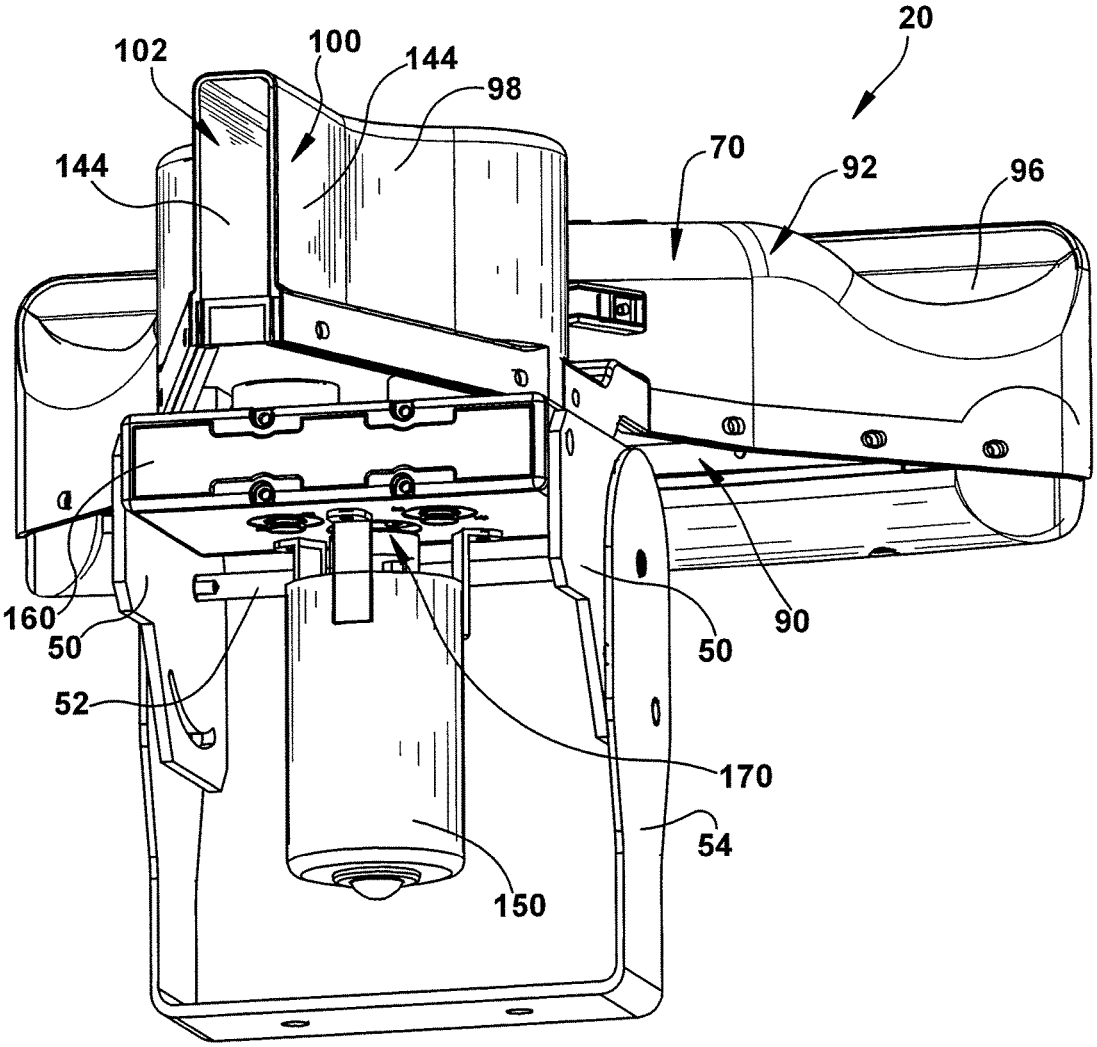
FIG. 8 is a perspective view of the conversion machine of FIG. 1, as seen from below and looking toward the upstream end of the conversion machine.

One of those components of the conversion assembly 72 that defines the path of the stock material through the converter 20 is the converging chute 74, best seen in FIGS. 4 and 7. The converging chute 74 has a first pair of opposed side walls 110 that generally converge towards each other in a downstream direction and second pair of opposed top and bottom walls 112 and 114 that interconnect the side walls 110. The converging walls 110 of the chute 74 define a progressively smaller cross-sectional area in the downstream direction whereby the stock material is turned in on itself and crumpled to form a strip of dunnage.

The top and bottom walls 112 and 114 also define a constriction 120 adjacent an upstream end of the chute 74 where the top and bottom walls 112 and 114 gradually converge towards each other to define a minimum distance therebetween of no more than about thirty millimeters.

In the illustrated embodiment, the top wall 112 includes an upper protrusion 122 that gradually curves to form a hemi-cylindrical shape. The protrusion 122 extends across the path of the stock material in the upstream-to-downstream direction. Other curved shapes also may be suitable. The bottom wall 114 also includes a corresponding cylindrical lower protrusion 124 generally aligned with the upper protrusion 122 to define the constriction 120. The longitudinal axis of either or both protrusions 122 and 124 may be straight or curved. The lower protrusion 124 also defines the lower upstream edge of the converter 20, and also presents a gradually curving surface to guide the stock material into the converging chute 74. The lower protrusion 124, which in the illustrated embodiment is bowed in the middle in an upstream direction, generally provides a relatively constant entry point for the stock material entering the converging chute 74.

The constriction 120 at the upstream end of the converging chute 74 limits the ability for foreign objects to enter the converging chute 74 that could interfere with the conversion process. The constriction 120 generally has a width that is about as wide as the stock material expected to be used with the converter 20. In an exemplary converter 20, the side walls 110 typically are spaced apart about eighty centimeters at the constriction 120.

The powered feed assembly 76 is similar to that disclosed in U.S. patent application Ser. No. 10/887,220, filed Jul. 8, 2004, and published under Publication No. 2005-0181924 on Aug. 18, 2005, which is hereby incorporated herein by reference. The feed assembly 76 has at least one rotatable member 130, and in the illustrated embodiment it includes a pair of rotatable members 130, for engaging and feeding stock material from a supply thereof through the converging chute 74 in a downstream direction. The rotatable members 130 further crumple the stock material and help to fix the crumpled stock material in its crumpled state.

The opposing rotatable members each have a plurality of paddles 132 uniformly circumferentially spaced apart. Each paddle 132 has a somewhat V-shape or outwardly opening cavity or indentation in the side thereof such that rotation of the rotatable members 130 causes the paddles 132 to sweep through a generally hourglass-shape volume. The opposing sets of paddles 132 together form a through-gap or channel 136 that gradually narrows as the paddles 132 progressively move toward each other as the rotatable members 130 rotate. The hourglass-shape volumes of the opposing rotatable members 130 can overlap one another as alternating paddles 132 move through the overlapping regions. In other words, the opposing paddles 132 sequentially move transversely toward or "close in" on each other as the rotatable members rotate to grip the stock material therebetween.

Once the opposing paddles 132 engage the strip of dunnage, they maintain a grip on the strip for the duration of their travel along the path of the stock material through the feed assembly 76. At the downstream end of the feed assembly 76, the opposing sets of paddles 132 gradually diverge away from each other to release the strip of dunnage.

The converter 20 also includes one or more guide members 140 that direct the gathered strip from the converging chute 74 and through the feed assembly 76 without significantly impairing the operation of the feed assembly 76 or the crumpling of the strip as it is fed therethrough. The guide members 140 extend from a position upstream of the feed assembly 76, through the gap 136 between the opposing rotatable members 130, to a position downstream of the feed assembly 76 to guide the stock material past the rotatable members 130. The guide members 140 typically are secured at an upstream end, such as to a portion of the housing 70 that defines the converging chute 74, and are free at a downstream end. Each guide member 140 generally has sufficient flexibility to move out of the way as the strip passes thereby, substantially between the guide members 140. The guide members 140 can be formed of nylon, such as nylon cable ties, also referred to as tie-wraps.

The feed assembly 76 feeds the stock material downstream and through the output chute 100 which guides the stock material to the outlet opening 102 thereof that is spaced from the feed assembly 76, and thus out of the converter 20. The output chute 100 provides a continuous path from the feed assembly 76 to the outlet opening 102. The output chute 100 has a pair of opposed walls 144 that have a minimum distance therebetween of no more than about thirty-two millimeters adjacent the outlet opening 102. The output chute 100 generally provides a rectangular passage for the stock material although it may have other shapes, including a trapezoid, for example, with a width near the top of the outlet opening 102 of about twenty-five millimeters and a width near the bottom of the outlet opening 102 of about thirty-two millimeters, and a height of about eighty-seven millimeters. The output chute 100 has a length of about one hundred fifty millimeters to about two hundred millimeters from the feed assembly 76 to the outlet opening 102. The narrow width of the output chute 100 restricts or limits or prevents entry into the output chute 100 by foreign objects that could interfere with the conversion process, as well as guiding the stock material and perhaps contributing to its formation into a strip of dunnage.

The feed assembly 76 is powered by a motor 150. In an exemplary embodiment, the rotatable members 130 of the feed assembly 76 are driven by a rotary electric motor 150, and at least one gear, and typically at least two gears in a gear train, for transferring rotational motion from the motor 150 to the rotatable members 130. The rotatable members 130 can be keyed or otherwise secured to respective shafts 152 for rotation therewith. The axes of the rotatable members 130 generally extend in a direction that is parallel to an axis of the shaft 154 of the motor 150. In the illustrated embodiment, the gear train includes a pinion gear 156 secured to the shaft of the motor 150 and a spur gear 156 and 158 secured to each shaft 152 of the rotatable members 130. The gears 156 and 158 thus transfer the rotational motion from the shaft of the motor 150 to the shafts 152 of the rotatable members 130.

A gear box 160 is interposed between the rotatable members 130 and the motor 150. The gear box 160 includes a housing 162, which includes a generally tubular portion 164 that has a generally rectangular cross-sectional shape and a pair of end covers 166 that close and seal the open ends of the tubular portion 164 and thereby enclosing at least one gear within the gear box 160. The gear box housing 162 has a first opening 170 therein through one side of the housing 162 for receipt of the shaft of the motor 150, and a pair of second openings 172 in another side of the housing 162, the opposing side, for example, for receipt of the shafts 152 of the rotatable members 130. The shafts 152 of the rotatable members 130 are mounted in the gear box housing 162 with bushings 176 in aligned openings in opposing sides of the gear box 160 and extend through the converter housing 70 to the rotatable members 130 enclosed therein on an opposite side of the bottom portion 90 of the converter housing 70.

The gear box housing 160 is mounted to the housing 70 of the converter and the motor 150 is mounted to the opposing side of the gear box 160 with the shaft 154 of the motor 150 entering the gear box housing 162 from an opposite side of the gear box housing 162 from the openings 172 through which the shafts 152 of the rotatable members 130 extend.

The motor 150 is typically a direct current (DC) motor. An exemplary DC motor is a twenty-four volt DC motor, such as one which can rotate its shaft at about 2,300 revolutions per minute, and provides approximately one hundred to one hundred and fifty watts of power. The power cord for the motor includes a quick disconnect connection for connection to a power supply.

Figure 10:
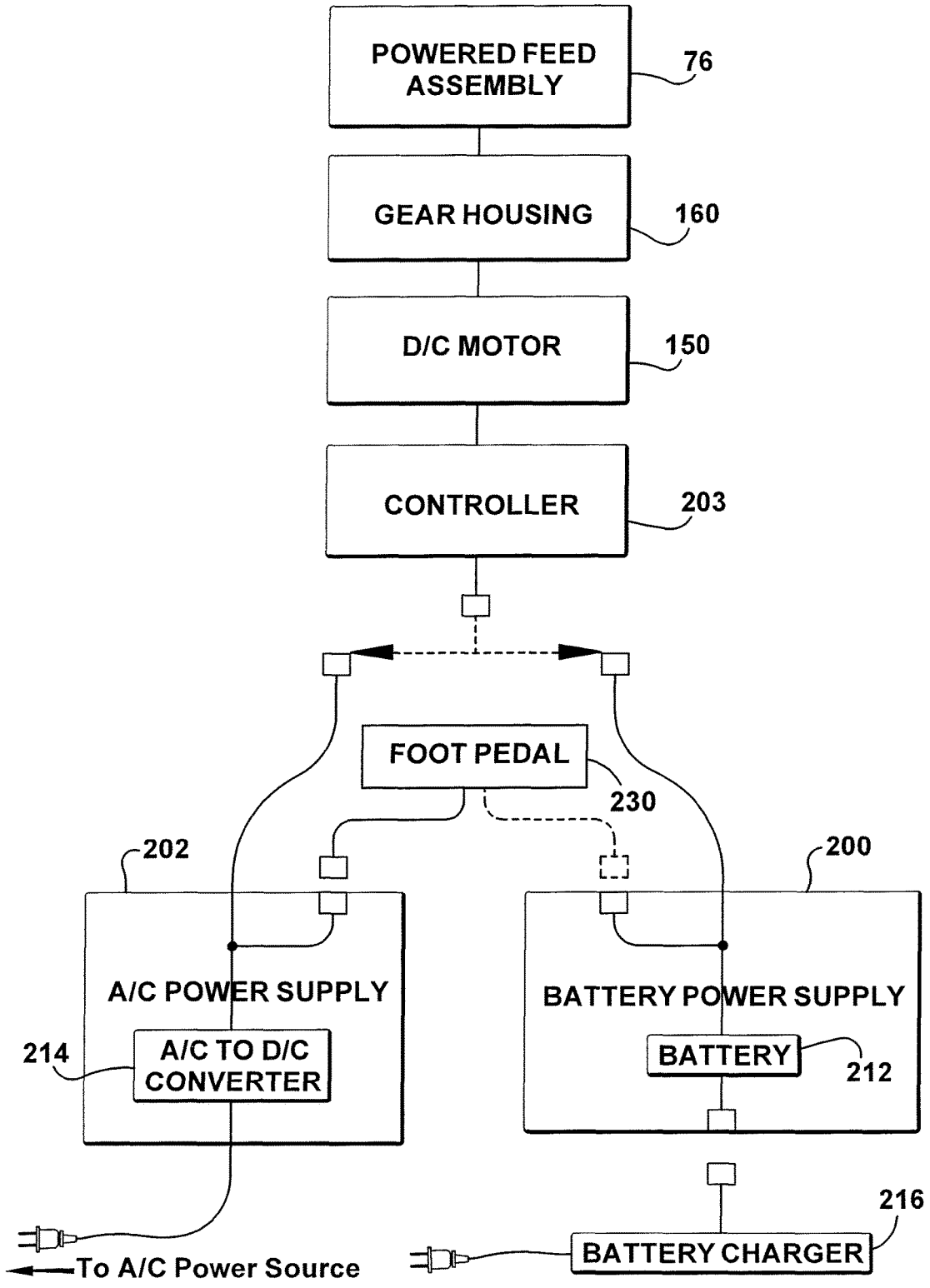
FIG. 10 is a schematic diagram of a powered portion of a conversion machine provided in accordance with the present invention.
Figure 11:
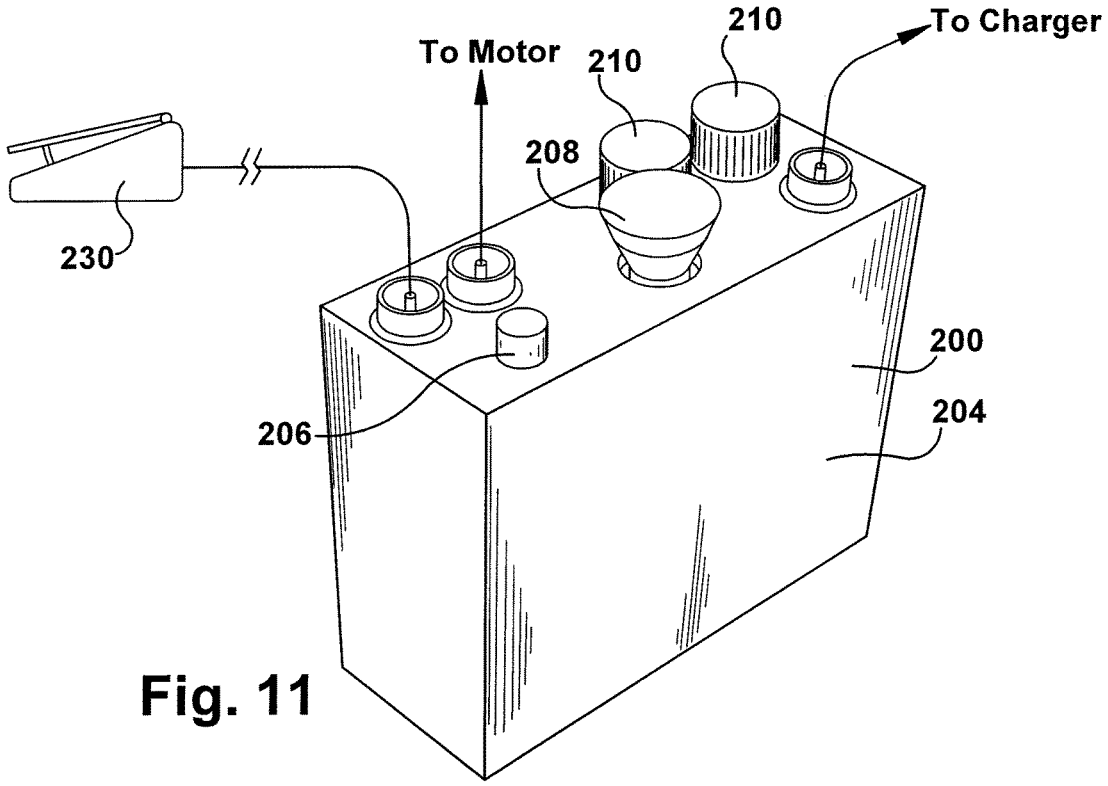
FIG. 11 is a perspective view of a power supply for the converter shown in FIG. 1, with a battery.
Figure 12:
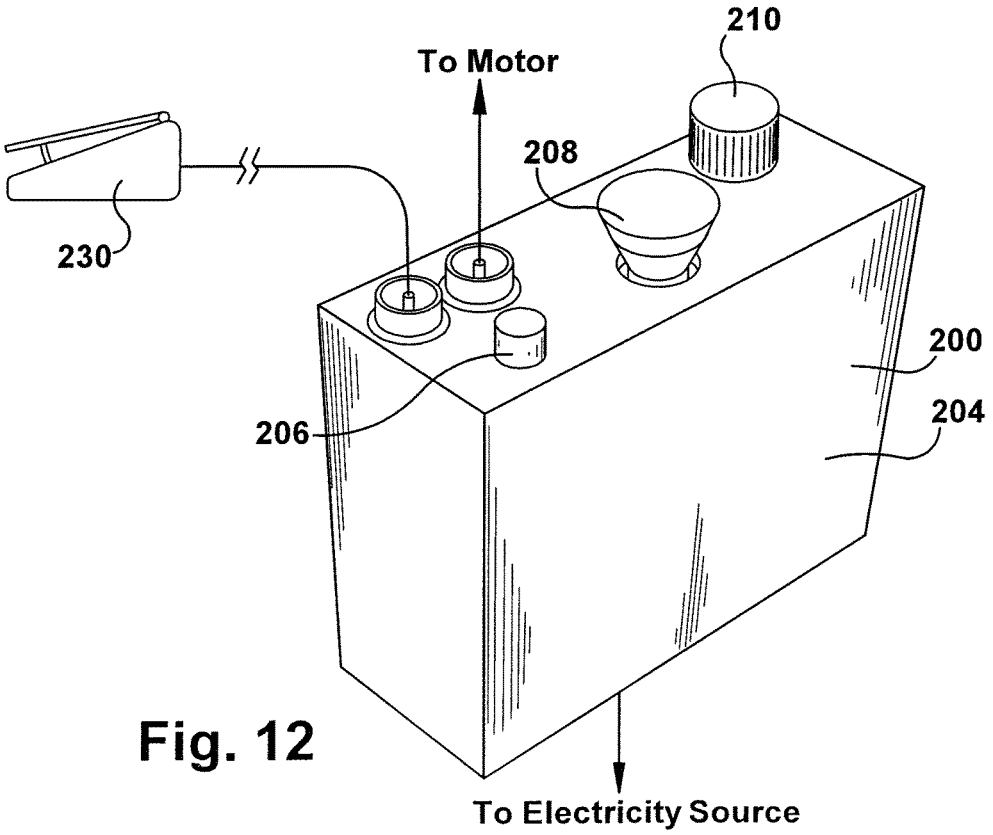
FIG. 12 is a perspective view of a power supply for the converter shown in FIG. 1, with an AC-to-DC converter.

Turning to FIGS. 10-12, the dunnage converter 20 also includes at least two power supplies 200 and 202 interchangeably connectable to the motor 150, and thus the powered feed assembly 76, to supply electrical power thereto. A controller 203 may be provided separately from the power supplies 200 and 202, or a controller may be incorporated in each power supply 200 and 202 to provide the necessary control functions. In an exemplary converter 20, each power supply 200 and 202 has a housing 204 that has the same dimensions as the other power supply or supplies. Consequently, the housing 204 for each power supply typically is substantially identical such that the power supplies 200 and 202 are readily swappable, one for another. Each power supply 200 and 202 can include an indicator light 206 to provide a visual output to indicate that the power supply 200 or 202 is operational, an emergency stop button 208 that can disconnect the power supply 200 or 202 in an emergency, and one or more fuses 210 that are accessible from outside the housing 204. A first power supply 200 has a battery 212 and a second power supply 202 is connectable to a source of alternating current (AC) and has an AC-to-DC converter 214 for supplying the direct current to the motor 150.

An exemplary power supply provides a 24 volt DC output with a current of no more than about six and a half amperes and provides approximately one hundred to one hundred fifty watts of power to the motor 150. The AC power supply 202 can be provided in 110 volt or 220 volt alternating current versions for converting that voltage into a direct current for provision to the motor 150. The AC power supply 202 includes a power cord 215 for connection to an outlet or other supply of alternating current, and the battery power supply 200 includes a connection 217 for a battery charger 216. A connection 219 is provided for connecting the power supply to the motor, and this connection also may provide a connection for recharging the battery.

In the illustrated embodiment, the stand 48 shown in FIG. 2 also includes a bracket 220 for mounting the power supply 200 or 202 to the upright 44. The power supply mounting bracket 220 has a pair of key slots 222 for receipt of a corresponding pair of screws (not shown) protruding from a back side of the power supply housing 204. Other mechanisms for mounting the power supply 200 or 202 and connecting the power supply 200 or 202 to the motor 150 are possible.

An input device, such as one or more foot pedals 230, is connectable to the power supply 200 and 202 to control the supply of power from the power supply 200 or 202 to the motor 150. For example, to produce dunnage a packer may press on the foot pedal until a desired length of dunnage is produced, and then release the foot pedal 230 to stop the converter. The packer can then tear the dunnage along a line of perforations at or downstream of the feed assembly 76. Alternatively, the packer can press the foot pedal 230 once to start the motor 150, and then press the foot pedal a second time to stop it. Other means for signaling the converter 20 and the feed assembly 76 to start and stop also may be employed.

Each power supply 200 and 202 also may include multiple connections for multiple foot pedals or other type of switch so that the converter can be used by multiple packers at various stations around the dunnage converter 20. For example, the converter 20 may be shared by two different packers at stations approximately ninety degrees apart from each other and the converter 20 may be rotated about the axis of the stand 40 for pointing the outlet opening 102 at the respective packer whereby the packer can use the nearest foot pedal 230 to control the supply of power and thus the conversion of stock material into a dunnage product.

Although the invention has been shown and described with respect to certain exemplary embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

What is claimed:

1. A dunnage converter for converting a sheet stock material into a relatively less dense dunnage product, comprising a powered feed assembly for feeding the stock material; the feed assembly having at least one rotatable member, a motor for driving the at least one rotatable member and a gear box interposed between the at least one rotatable member and the motor for transferring rotational motion from the motor to the at least one rotatable member; the gear box including a gear housing that encloses at least one gear; the gear housing having a first opening therein for receipt of a shaft of the motor and a second opening for receipt of a shaft for each rotatable member.

2. A converter as set forth in claim 1, wherein the motor shaft is drivably connected to a pinion gear that engages at least one spur gear drivably connected to the shaft of the rotatable member.

3. A converter as set forth in claim 1, wherein the motor shaft passes through one side of the gear housing and the shaft for the rotatable member passes through an opposing side of the gear housing.

4. A converter as set forth in claim 1, wherein the motor is mounted to the gear housing.

5. A converter as set forth in claim 1, wherein the converter has a converter housing that defines a path for sheet stock material to pass between the rotatable member, the gear housing being mounted to the converter housing adjacent the rotatable member.

* * * * *